US006877961B2

(12) United States Patent
Fujiwara et al.

(10) Patent No.: US 6,877,961 B2
(45) Date of Patent: Apr. 12, 2005

(54) VANE PUMP WITH A BYPASS VALVE AND PASSAGE ARRANGEMENT FOR EQUALIZING EXCESS FLUID FLOW THROUGH DUAL SUCTION PASSAGES

(75) Inventors: Hidetoshi Fujiwara, Nukata-gun (JP); Yoshinori Suzuki, Okazaki (JP); Kentaro Yamauchi, Okazaki (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 92 days.

(21) Appl. No.: 10/422,785

(22) Filed: Apr. 25, 2003

(65) Prior Publication Data

US 2003/0202888 A1 Oct. 30, 2003

(30) Foreign Application Priority Data

Apr. 26, 2002 (JP) ..... 2002-125371

(51) Int. Cl.[7] ..... F04B 49/24

(52) U.S. Cl. ..... 417/310; 417/440; 417/79; 417/80; 417/83; 417/88; 417/89

(58) Field of Search ..... 417/310, 440, 417/79, 80, 83, 88, 89

(56) References Cited

U.S. PATENT DOCUMENTS 3,439,623 A 4/1969 Dietrich et al.
5,170,626 A * 12/1992 Ohtaki et al. ..... 60/468
5,822,988 A * 10/1998 Kato ..... 60/468
6,287,094 B1 * 9/2001 Bleitz et al. ..... 417/440
6,299,418 B1 * 10/2001 Honaga et al. ..... 417/440
6,604,913 B1 * 8/2003 Koyama et al. ..... 417/310
6,742,996 B1 * 6/2004 Ueda et al. ..... 417/310

FOREIGN PATENT DOCUMENTS

EP 0 505 033 9/1992
JP 5-96483 4/1993

* cited by examiner

*Primary Examiner*—Cheryl J. Tyler
*Assistant Examiner*—Emmanuel Sayoc
(74) *Attorney, Agent, or Firm*—Oblon, Spivak, McClelland, Maier & Neustadt, P.C.

(57) ABSTRACT

In a housing of a pump apparatus having a flow control valve to discharge a part of excess fluid in a deviated slanting way to a bypass pass 11, a pair of suction paths 19, 19' is formed opposite to end portions 119, 119' of the bypass path 11 to send operation fluid to suction ports of the pump apparatus. A dividing wall is equipped at opening portions of said pair of suction paths 19, 19' to distribute the operation fluid to each of suction paths 19, 19'. A cross sectional area of one of said opening portions in a side of a direction of said deviated slanting way is smaller than a cross sectional area of the other of said opening portions in an opposite side of the deviated slanting way to relatively restrict a flow of said operation fluid in said one of opening portions.

3 Claims, 4 Drawing Sheets

VANE PUMP WITH A BYPASS VALVE AND PASSAGE ARRANGEMENT FOR EQUALIZING EXCESS FLUID FLOW THROUGH DUAL SUCTION PASSAGES

INCORPORATION BY REFERENCE

The present application claims priority under 35 U.S.C. §119 to Japanese Patent Application No. 2002-125371, filed on Apr. 26, 2002. The contents of that application are incorporated herein by reference in their entirety.

BACKGROUND OF THE INVENTION

1. Field of the Invention

The invention relates to a pump apparatus for various fluid devices, for example a fluid pressure power steering apparatus. Especially, the invention relates to a bypass path, formed between a flow control valve and a suction portion of the pump apparatus, and a dividing wall formed opposite to an end portion of the bypass path to suck operation fluid.

2. Description of the Related Art

It is typically known a vane pump apparatus for a fluid pump apparatus using for a fluid pressure power steering apparatus. A vane pump apparatus is, for example, disclosed in the U.S. Pat. No. 6,299,418. The typically known vane pump apparatus has a flow control valve 10 to return as excess fluid to the pump a part of discharged fluid from a pump unit discharging operation fluid to the power steering apparatus in order to send constant volume of operation fluid to the power steering apparatus. Such flow control valve is disclosed in Japanese Utility Model laid-open publication No.05-096483 and said U.S. Pat. No. 6,299,418.

The typically known vane pump apparatus is shown in FIG. 1. A vane pump apparatus includes a bypass path 30 between a flow control valve and a suction portion of the pump apparatus to be communicated with suction paths 20, 20' of a path for the suction portion. Excess fluid is flowing into the bypass path. Adjacent to a connecting portion of the bypass path 30 to the flow control valve 10 is formed an opening portion 90 of a reservoir path communicated with a reservoir. The bypass path 30 is at its end portion to be connected with left and right suction paths 20, 20'. Operation fluid discharged from a pump unit is introduced through an introducing path 50 to the flow control valve 10. A part of said operation fluid controlled by the flow control valve 10 is discharged as excess fluid from a bypass hole 310 through a clearance formed at a head of a spool 150. A direction of the discharged excess flow is in a deviated slanting way shown in FIG. 1 because of a retracting direction of the spool 150 and a position of the introducing path 50. In recent year, the vane pump apparatus is needed to discharge larger volume of said fluid in higher pressure so that excess fluid discharged in the deviated slanting way acts more strongly against the bypass path 30. A side wall 330 of the bypass path 30 in a direction of the deviated slanting way is able to receive damages by discharged excess fluid. Relating to this damage, said Japanese Utility Model laid-open publication No.05-096483 or said U.S. Pat. No. 6,299,418 discloses a technology of an ellipse form of a cross section of the bypath path and the ellipse form has a wider length width than a breadth width. The technology reduces energy of said discharged fluid and thereby reduces damages of the side wall 330 of the bypass path 30.

In the typically known vane pump apparatus, as shown in FIG. 1, when said operation fluid flowing in the bypass path is divided into each of said suction paths 20, 20', more operation fluid flow into the suction path 20 at a side in a deviated slanting way. This makes an un-equivalent volume of divided operation fluid in left and right suction paths to cause a generation of a vibration and a noise in an operation of the pump apparatus.

SUMMARY OF THE INVENTION

In view of the previously mentioned circumstances, it is an object of the present invention to provide a pump apparatus reducing a vibration and a noise in an operation of the pump apparatus.

It is further object of the present invention to provide a vane pump apparatus reducing a manufacturing cost by using common parts.

In order to achieve the above and other objects, the present invention provides a pump apparatus comprising at least a flow control valve, a bypass path, a dividing wall and a pair of suction paths. The flow control valve discharges constant volume of operation fluid to a fluid apparatus by returning a part of discharged fluid from the pump apparatus as excess fluid to a suction portion of the pump apparatus, and the flow control valve has a bypass hole discharging said excess fluid in a "deviated slanting way". The "deviated slantine way" is defined as the direction of the flow of excess fluid through the bypass hole, which is oblique to the length, or central axis, of the bypass hole such that the discharged fluid is discharged to an incident side of the bypass passage. The dividing wall formed opposite to the bypass path distributes operation fluid to said pair of suction paths. An end portion of the bypass path defines a pair of opening portions of the suction paths at the dividing wall. A cross sectional area of one of said opening portions on the incident side of the bypass path is smaller than a cross sectional area of the other of said opening portions on an opposite side, the incident side of the bypass path.

The pump apparatus can make equivalent volume of the sucked operation fluid distributed at left and right suction path. The area formed in said one of opening portions on the incident side of the bypass pass is smaller than the area of the other of said opening portions on an opposite side, the incident side of the bypass path, such that distributed volume of operation fluid in the bypass path is intended to be divided more to the area with a larger area because of an area difference so that each volume a time of said operation fluid flowing in each of left and right suction paths is substantially equivalent in order to eliminate insufficiency of flowing volume of operation fluid to the other suction path based on the discharged slanting way. Therefore the invention improves to reduce vibration and noise at the operation of this pump apparatus.

The other aspect of the invention is that a first width of a cross section of said bypass path measured from the side of the bypass passage incident to the discharge of said excess fluid and the opposite side of the bypass path is larger than a second width of said cross section of said bypass path measured in a direction transverse to said first width; and a length of a first side wall of said bypass path which is incident to the discharge of said excess fluid is longer than a second length of a side wall of said bypass path not incident to the discharge of said excess fluid. Therefore, said two areas are adjusted by changing the length of the side walls to keep the equivalent volume of said operation fluid when the direction of deviated slanting way of discharged excess fluid is changed. Thereby, it is easy to keep the equivalency to make it possible be a common use and a common part of the pump apparatus in order to reduce a manufacturing cost.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
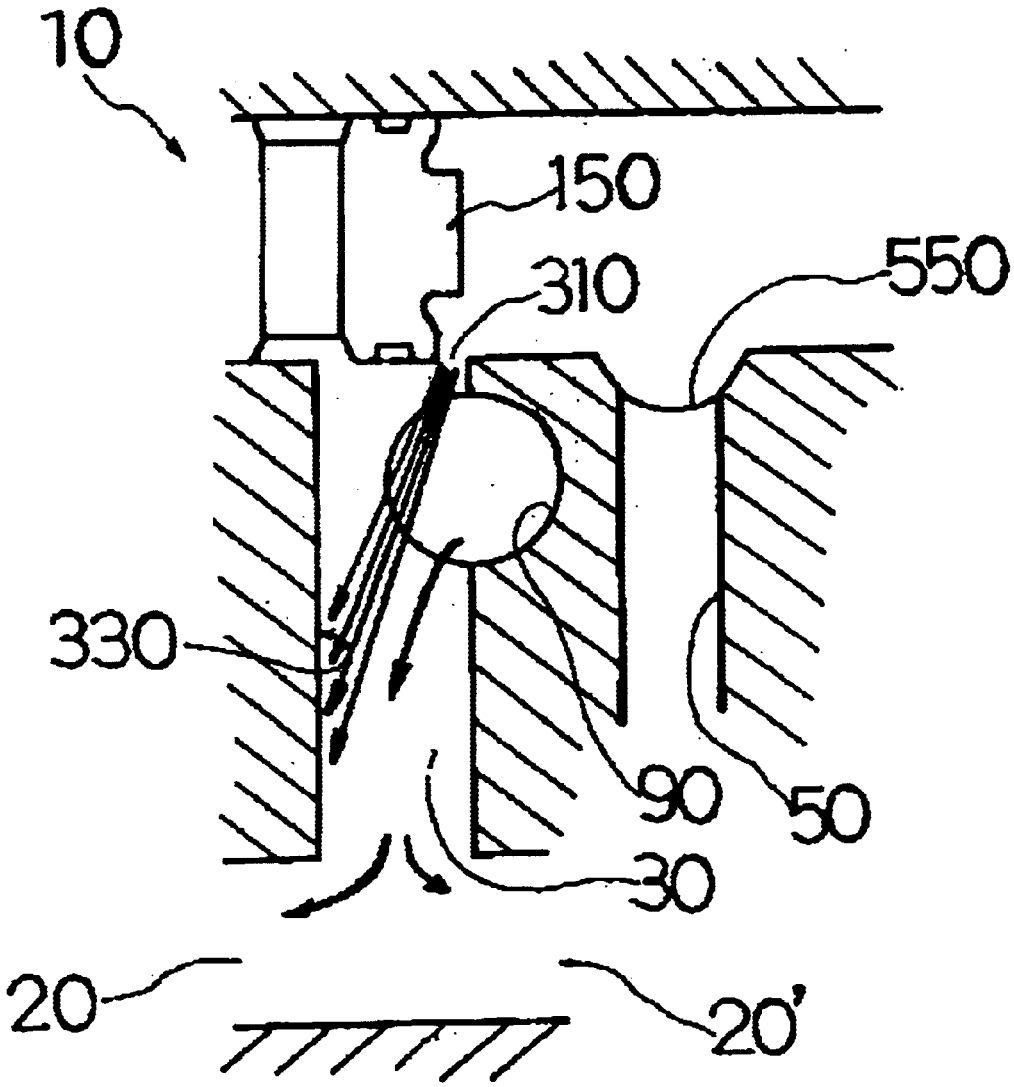
Prior Art FIG. 1
FIG. 1 is a flow control valve and a bypass path of a conventional pump apparatus of a related art.
Figure 2:
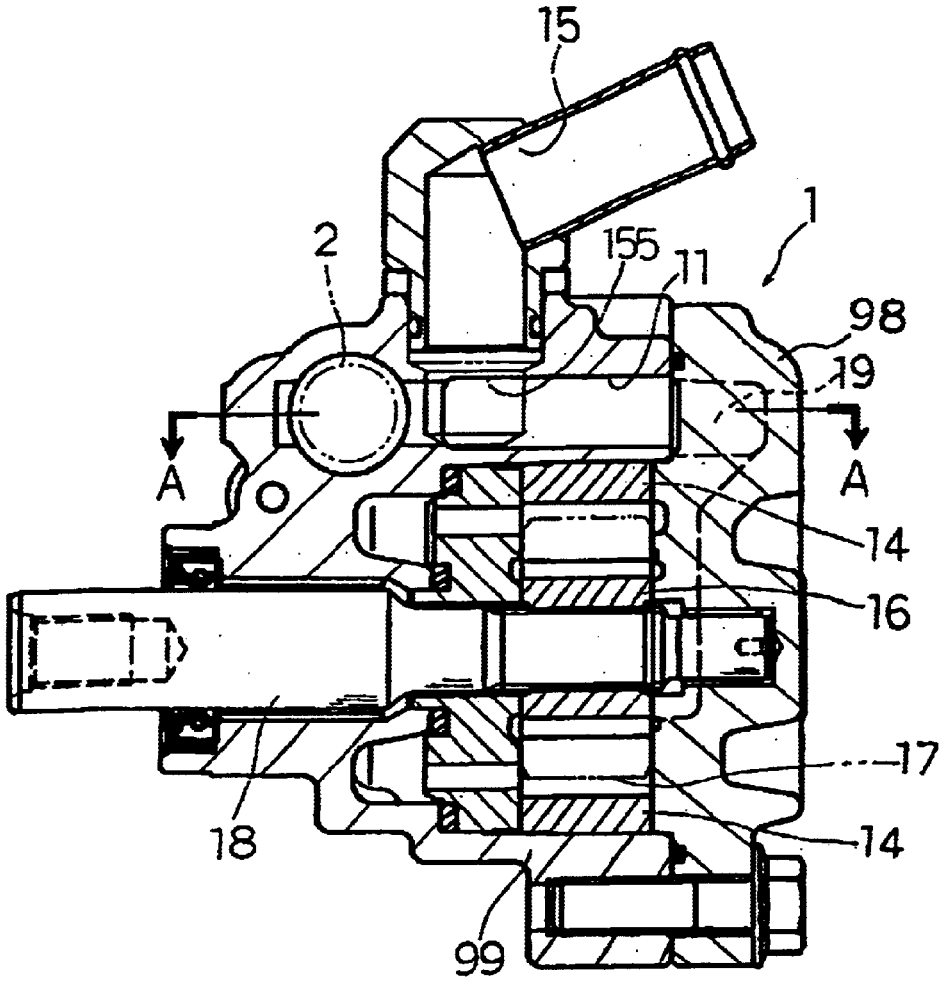
FIG. 2 is a cross sectional view of a whole construction of a pump apparatus according to an embodiment of a present invention.
Figure 3:
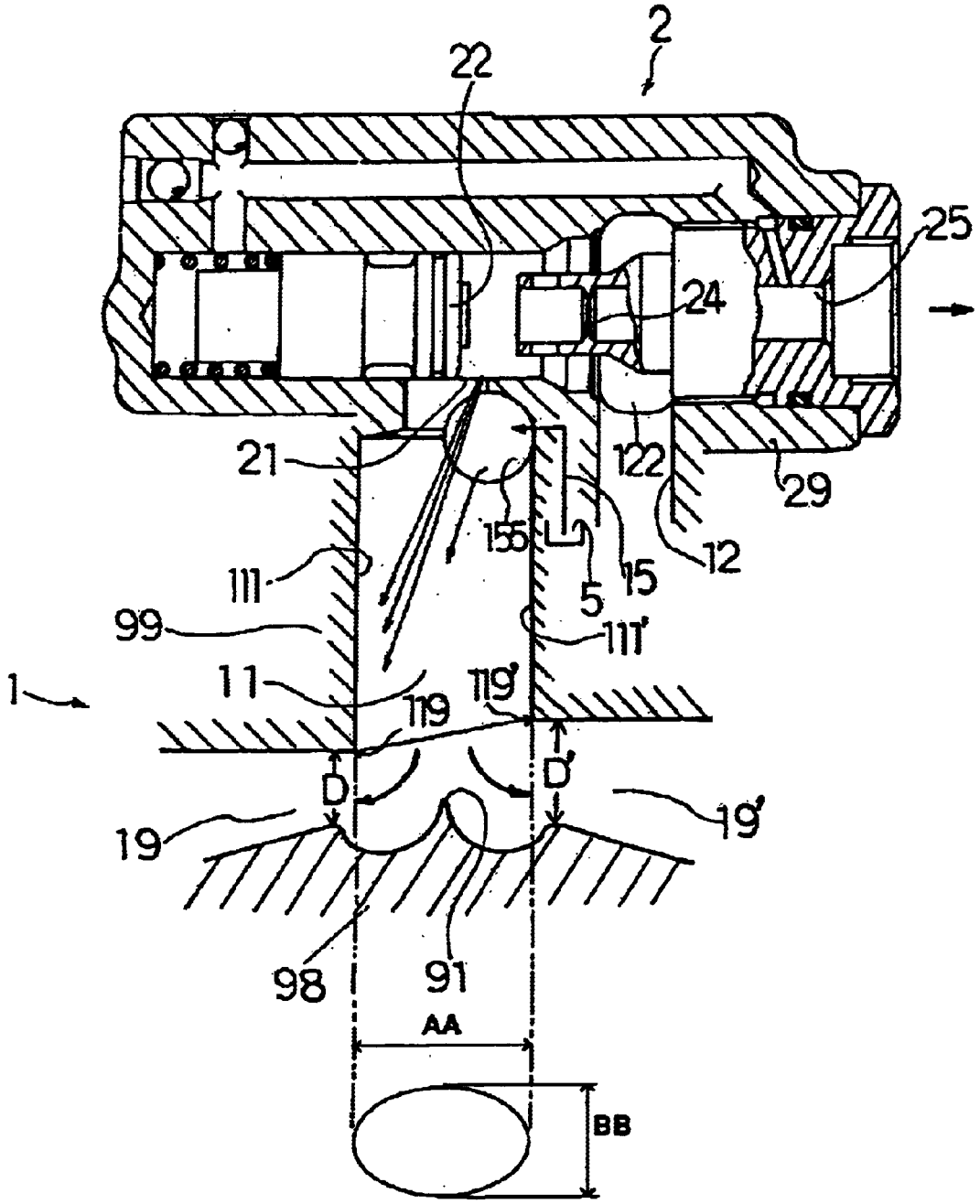
FIG. 3 is a A–A cross sectional view of a whole construction of a pump apparatus in FIG. 2 according to an embodiment of a present invention.
Figure 4:
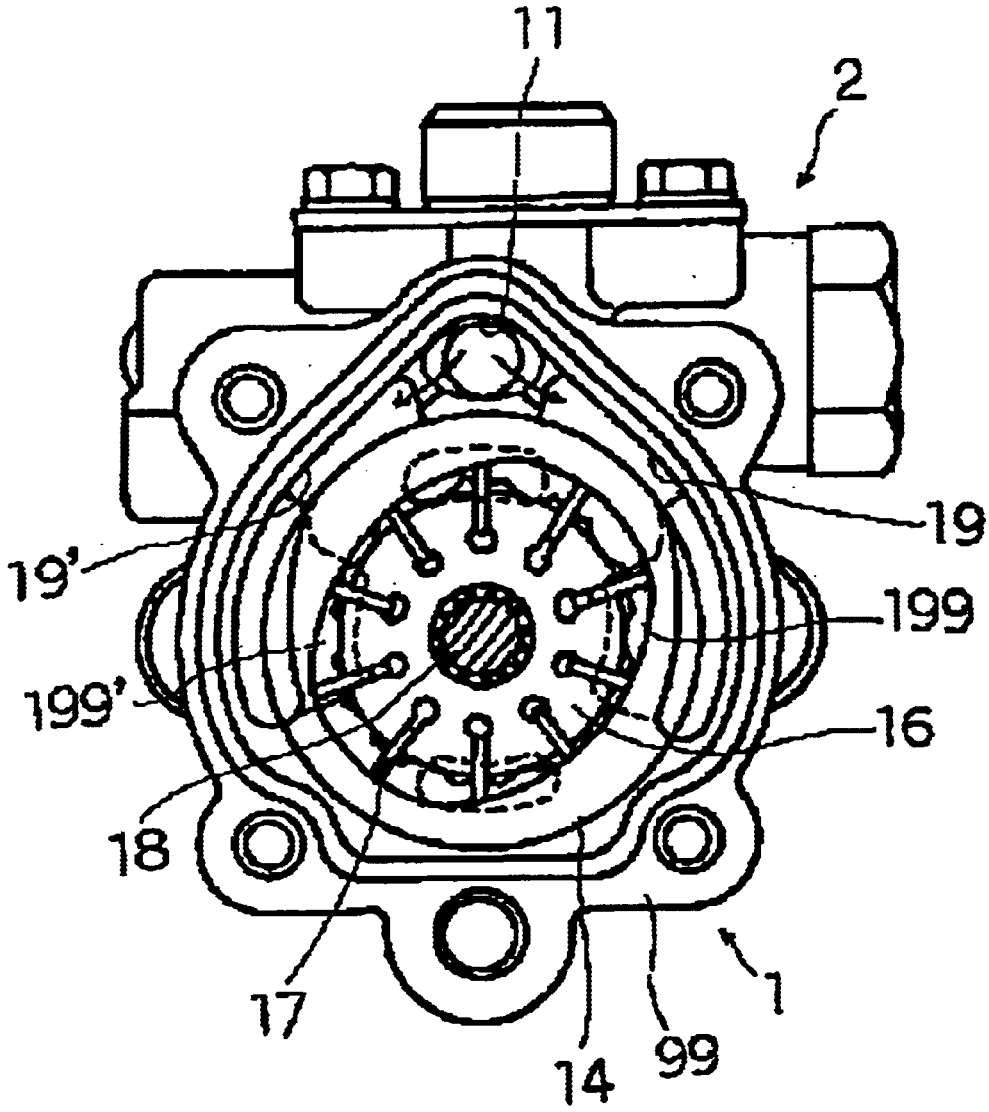
FIG. 4 is a side cross sectional view of a whole construction of a pump apparatus according to an embodiment of a present invention.

A preferred embodiment of a pump apparatus according to the aforementioned invention will be described referring to FIG. 2 to FIG. 4. Referring to FIG. 2, the embodiment of the invention basically consists of a pump unit 1 and a flow control valve 2. The pump unit 1 operates to provide operation fluid or pressurized fluid to a predetermined fluid device, for example a fluid pressure power steering apparatus. The flow control valve 2 returns a part of discharged fluid as excess fluid to a suction port of the pump unit 1 in order to provide constantly a predetermined volume of operation fluid from the pump unit 1 to said fluid apparatus. The pump unit 1 is a vane pump unit as shown in FIG. 2 to FIG. 4. The vane pump unit 1 consists of a rotating shaft 18, a rotor 16, a plurality of vanes 17, a cam ring 14, a housing 99, a cover 98, and so on. The rotor 16 is coupled with the rotating shaft 18 by a spline and said plural vanes 17 are slidably urged in a plurality of slots of the rotor 16. The cam ring 14 restricts a pump chamber out of the vanes 17. The housing 99 contains a pump function parts such as the cam ring 14, vanes 17, the rotor 16 and so on, and the cover 98 makes a pair with the housing 99.

The flow control valve 2 consists of a valve housing 29 being a part of the housing 99 of the vane pump unit 1. The flow control valve 2 further consists of a throttle 24 to control the volume of the operation fluid to said fluid apparatus through an output port 25 and a spool 22 operated by a differential pressure between upper and downward stream of the throttle 24. There is a bypass hole 21 in the valve housing 29 between the throttle 24 and a head of the spool 22 to return said excess fluid to the vane pump unit 1. A bypass path 11 is formed in the housing 99 to be connected with the bypass hole 21 to flow said excess fluid to suction paths 19, 19', as shown in FIG. 4, communicated with left and right suction ports 199, 199' provided in the vane pump unit 1. An opening portion or opening hole 155 is formed adjacent to a connecting portion of the bypass hole 21 and the bypass path 11 and the opening portion 155 consists of a part of a reservoir path 15 communicated with a reservoir 5. There is an introducing path 12 to introduce discharge fluid from the vane pump unit 1 and the introducing path 12 is connected to an area adjacent to the throttle 24 through an introducing port 122.

Referring to FIG. 3, a dividing wall 91 is formed in the cover 98 opposite to the bypass path 11 to distribute said operation fluid to left and right suction ports 199, 199'. In this place of the cover 98, said suction paths 19 and 19' are symmetrically formed on left and right sides of the dividing wall 91 as shown in FIG. 3 and FIG. 4. Said suction paths 19 and 19' are communicated with the suction ports 199, 199' as shown in FIG. 4.

As shown in FIG. 3, a sectional form of the above-mentioned bypass path 11 is formed as a shape that a length width AA of the sectional form is wider than a breadth width BB, for example an ellipse shape. When the excess of said operation fluid is discharged in a deviated slant way from a clearance between the head of the spool 22 and the bypass hole 21 in the flow control valve 2, it takes certain time and length for said slanting discharged fluid to reach a side wall 111 of the bypass path 11 because of the ellipse shape. Therefore, the time and the length for said fluid reaching to the side wall 111 are substantially enough to mitigate shock wave of said fluid against the side wall 111 to widely spread energy of a collision of said fluid so that it stops the side wall 111 to be removed in order to eliminate a generation of erosion. In addition to this point, each length of said side wall 111 and a side wall 111' at both sides of the bypass path 11 in a direction of the length width AA is moreover different. Said length of the side wall 111 on the side of the bypass path incident the excess fluid , that is the length at opposite side to a side of the introducing port 122 of the introducing path 12, is longer than that of the side wall 111' at opposite side to the side wall 111. By this different length, each of end portions 119, 119' of both said side walls 111, 111' forming opening portions of both suction paths 19, 19' defines each of cross sectional areas D and D' of both suction paths 19 and 19' so as to restrict a flow of the operation fluid in the area D relatively smaller than in the area D'. The area D of one of said opening portions on the incident side of the bypass pass and the area D' of the other of said opening portions is in an opposite side of the bypass path. This means the area D is smaller than the area D', that is to say D<D'. Therefore, the area D receiving more operation fluid than the area D' based on the deviated slanting way has relatively restricted area so that each volume a time of said operation fluid flowing in each of left and right suction paths 19, 19' is substantially equivalent.

An operation of the preferred embodiment of the invention is now described hereinafter.

When the vane pump unit 1 operates to discharge operation fluid, the discharged fluid is introduced to the throttle 24 through the introducing path 12 and the introducing port 122. A part of discharged fluid is discharged as excess fluid through the clearance between the head of the spool 22 and the bypass hole 21. Assisted by being discharged as excess fluid, said operation fluid is sucked from the reservoir 5 to the bypass path 11 through opening portion 155. A discharged direction of operation fluid including excess fluid and sucked fluid is a direction of the deviated slanting way as shown by an arrow in FIG. 3. Therefore, larger volume of said operation fluid is intended to be flown with assisted power in the direction of the deviated slanting way at the end portion 119, 119'. However in the embodiment of the invention with the area D formed in said one of opening portions in the side of the deviated slanting way and with the area D' opposite to the area D, the area D is smaller than the area D'. Therefore, said flowing volume of operation fluid in the bypass path 11 is intended to be divided more to the area D' with weaker flowing of operation fluid and with a larger area because of an area difference so that each volume a time of said operation fluid flowing in each of left and right suction paths 19, 19' is substantially equivalent in order to eliminate insufficiency of flowing volume of operation fluid to the right suction path 19' with the weaker flowing of operation fluid based on the discharged slanting way. As a result, said volume of the operation fluid at the suction port 199, 199' is substantially equivalent. Therefore the embodiment of the invention improves to reduce sound pressure at the operation of this pump apparatus.

The areas D, D' are adjusted by changing the length of the side walls 111, 111' to make the equivalency of said operation fluid. When a position of the output port 25 is changed by a specification change to alter the direction of discharged excess fluid, it can be adjusted corresponding to the change by altering the length of the side walls 111, 111', that is to say only change of a design of the housing 99. Therefore, there is no need to change a design of the cover 98 equipped with the suction path 19, 19' to make it possible be a common use and a common part in order to reduce a manufacturing cost.

In the pump apparatus according to the present invention, because the area formed in one of opening portions of the pair of suction paths in the incident side of the bypass path with stronger flowing of operation fluid is smaller than the area of the other of said opening portions in the opposite side of the bypass path, distributed volume a time of operation fluid in the bypass path is substantially equivalent to eliminate insufficiency of flowing volume of operation fluid to the other suction path based on the discharged slanting way. Therefore the invention can make the equivalent delivery to perform a smooth operation of the pump apparatus by reducing vibration and noise.

Further in the pump apparatus according to the present invention, a first width AA of a cross section of the bypass path, measured from the side of the bypass passage incident to the discharge of said excess fluid and the opposite side of the bypass path, is larger than a second width BB of the cross section of said bypass path, measured in a direction transverse to said first width. A length of a first side wall of said bypass path which is incident to the discharge of said excess fluid is longer than a second length of a side wall of said bypass path not incident to the discharge of said excess fluid. Therefore, said two areas are adjusted by changing the length of the side walls to keep the equivalent volume of said operation fluid when the direction of deviated slanting way of discharged excess fluid is changed. Thereby, it is easy to keep the equivalency. And the cover with the dividing wall and the opening portions of suction paths is common in changing of the specification of the flow control valve to reduce a manufacturing cost.

Obviously, numerous modifications and variations of the present invention are possible in light of the above teachings. It is therefore to be understood that within the scope of the appended claims, the present invention may be practiced otherwise than as specifically described herein.

What is claimed is:

1. A pump apparatus comprising:

a housing;

a cover opposite to said housing;

a flow control valve mounted in said housing, said flow control valve discharging constant volume of operation fluid to a fluid apparatus by returning a part of discharged fluid from said pump apparatus as excess fluid to a suction portion of said pump apparatus, and said flow control valve having a bypass hole to discharge said excess fluid in a direction which is oblique to the length of the bypass hole such that the discharged fluid is discharged to an incident side of the bypass passage;

a bypass path formed in said housing to connect said bypass hole to said suction portion in order to send said excess fluid; and a pair of suction paths formed in at least one of said cover and said housing, said pair of suction paths being connected to an end portion of said bypass path via a pair of opening portions, said suction paths communicating to said suction portion of said pump apparatus, wherein said cover has a dividing wall opposite to said bypass path to distribute said operation fluid to said pair of suction paths; and a cross sectional area of one of said opening portions which is on the incident side of the bypass path is smaller than a cross sectional area of the other of said opening portions which is opposite to the incident side of the bypass path to restrict a flow of said operation fluid in said one of said opening portions relative to the other of said opening portions.

2. The pump apparatus according to claim 1, wherein a first width of a cross section of said bypass path measured from the side of the bypass passage incident to the discharge of said excess fluid and the opposite side of the bypass path is larger than a second width of said cross section of said bypass path measured in a direction transverse to said first width; and a length of a first side wall of said bypass path which is incident to the discharge of said excess fluid is longer than a second length of a side wall of said bypass path not incident to the discharge of said excess fluid.

3. The pump apparatus according to claim 1 or claim 2, wherein said pump apparatus further comprises a plurality of vanes, a rotor and a cam ring in said housing; and each of said suction paths is formed in said cover symmetrically at said dividing wall.

* * * * *